US009963892B2

(12) United States Patent
Cowell

(10) Patent No.: US 9,963,892 B2
(45) Date of Patent: May 8, 2018

(54) MODULAR PRIVACY BOOTH FOR COOPERATIVE USE WITH A TELLER STATION, ATM, OR THE LIKE

(71) Applicant: Justin D. Cowell, Virginia Beach, VA (US)

(72) Inventor: Justin D. Cowell, Virginia Beach, VA (US)

( * ) Notice: Subject to any disclaimer, the term of this patent is extended or adjusted under 35 U.S.C. 154(b) by 5 days.

(21) Appl. No.: 15/202,009

(22) Filed: Jul. 5, 2016

(65) Prior Publication Data

US 2016/0356052 A1 Dec. 8, 2016

Related U.S. Application Data

(63) Continuation-in-part of application No. 14/178,743, filed on Feb. 12, 2014, now abandoned.

(51) Int. Cl.

| | |
|---|---|
| ***E04H 1/12*** | (2006.01) |
| ***E05G 5/02*** | (2006.01) |
| ***E05G 7/00*** | (2006.01) |
| ***G07F 19/00*** | (2006.01) |
| ***A47B 83/00*** | (2006.01) |
| *E04H 1/06* | (2006.01) |
| *E04H 3/08* | (2006.01) |

(52) U.S. Cl.

CPC ..... *E04H 1/125* (2013.01); *A47B 83/001* (2013.01); *E05G 5/02* (2013.01); *E05G 7/00* (2013.01); *G07F 19/205* (2013.01); *A47B 2200/007* (2013.01); *A47B 2200/0071* (2013.01); *E04H 1/06* (2013.01); *E04H 3/08* (2013.01)

(58) Field of Classification Search

CPC ..... G07F 19/2055; E04H 1/12; E04H 1/06; E04H 1/125; E05G 7/00; E05G 5/02; E04F 11/002; A61G 7/1076; A61G 3/0808; A61G 5/0825; B66F 7/16; B66F 7/025; A63G 31/16; B66B 9/0853; B66B 9/04; B66B 9/00

USPC ..... 109/2, 4–7, 9–11, 48

See application file for complete search history.

(56) References Cited

U.S. PATENT DOCUMENTS 2,156,859 A * 5/1939 Lowe ..... E04H 3/08 52/106

2,691,448 A * 10/1954 Lontz ..... E04H 6/285 194/902

(Continued)

*Primary Examiner* — Suzanne L Barrett

(74) *Attorney, Agent, or Firm* — William G. Sykes

(57) ABSTRACT

A privacy booth for isolating a user from the surrounding environment so as to provide acoustical and possibly visual privacy to the user. A single privacy booth may be utilized when a user must interact with an electronic device or terminal, for example, an ATM. When interacting with a human, for example, a bank teller, a pair of joined privacy booths provide acoustical and visual privacy to both interacting parties. The solid but possibly transparent barrier between the user and the teller helps prevent "snatch and grab" type crimes and protects the teller from armed robbery attempts. Access to the user's privacy booth may be controlled using access keypads that open semi-circular doors. A transaction pass-through tube allows for passing documents, etc. back and forth between the user and the teller. The privacy booth may have an elevatable and rotatable floor allowing access to wheel chair confined persons.

15 Claims, 12 Drawing Sheets

(56) References Cited

U.S. PATENT DOCUMENTS

| | | | | | |
|---|---|---|---|---|---|
| 3,439,815 | A * | 4/1969 | Wagner | B65G 1/045 | 414/263 |
| 3,497,087 | A * | 2/1970 | Vita | E04H 6/287 | 414/252 |
| 4,264,257 | A * | 4/1981 | Saurwein | E04H 6/287 | 414/253 |
| 4,475,465 | A * | 10/1984 | Hastings | E05G 5/02 | 109/2 |
| 4,594,044 | A * | 6/1986 | Soot | E04H 6/282 | 414/263 |
| 5,105,915 | A * | 4/1992 | Gary | A61G 3/063 | 14/71.3 |
| 5,980,185 | A * | 11/1999 | Vita | E04H 6/287 | 414/254 |
| 9,016,999 | B2 * | 4/2015 | Dezer | E04H 6/22 | 414/232 |
| 9,255,420 | B2 * | 2/2016 | Dezer | E04H 6/22 | |
| 2004/0262383 | A1 * | 12/2004 | Zielinski | G07C 9/00126 | 235/382 |
| 2011/0174200 | A1 * | 7/2011 | Bartel | E05G 1/00 | 109/59 T |
| 2014/0373761 | A1 * | 12/2014 | Osann, Jr. | E05G 5/003 | 109/6 |

* cited by examiner

MODULAR PRIVACY BOOTH FOR COOPERATIVE USE WITH A TELLER STATION, ATM, OR THE LIKE

RELATED APPLICATIONS

This is a Continuation-in-Part application of U.S. patent application Ser. No. 14/178,743 for MODULAR PRIVACY BOOTH FOR COOPERATIVE USE WITH A TELLER STATION, ATM, OR THE LIKE filed Feb. 12, 2014 and which is included by reference herein in its entirety.

FIELD OF THE INVENTION

The invention pertains to privacy booths and, more particularly, to privacy booths associated with transaction terminals or customer service windows.

BACKGROUND OF THE INVENTION

Identity theft continues to be one of the fastest growing crimes in the United States. It is important for consumers to recognize that identity theft is not just a financial crime. This crime varies widely, and can include financial identity theft (checking and/or credit card fraud), criminal identity theft, governmental identity theft, and medical identity theft. The Identity Theft Resource Center® (ITRC www.identitytheftcenter.org) is a nonprofit, nationally respected organization dedicated exclusively to the understanding of identity theft and related issues. The ITRC provides victim and consumer support as well as public education. The ITRC also advises governmental agencies, legislators, law enforcement, and businesses about the evolving and growing problem of identity theft.

When personal and/or financial information is publically disclosed, for example at the teller window of a bank, credit union, medical facility, or numerous other similar places, there is generally some risk that all or part of that information may be compromised (i.e., "stolen") by a person not authorized to have access to that information. When information is entered into a public computer terminal or apparatus, for example, an Automated Teller Machine (ATM), there is still a risk of personal information such as a Personal Identification Number (PIN) being observed by an unauthorized person. Further, a financial transaction at a teller window may be compromised when a teller innocently asks a customer making cash withdrawal a question such as "how would you like the money, in one-hundreds, fifties, twenties, etc." Such information may alert an observer to the fact that the customer will soon be carrying a possible substantial amount of cash.

In medical facilities, for example doctor's offices, hospital emergency room registration desks, pharmacies, or the like, personal information divulged by a client may be overheard.

In many facilities, a queue of waiting customers or patients are requested to stay an appropriate distance away from a window, counter, etc. where another person is conducting a transaction. Even with this precaution, it is still possible for a person in the queue to overhear some portion of the transaction.

DISCUSSION OF THE RELATED ART

The prior art shows several proposed solutions for limiting or eliminating the loss of sensitive information disclosed by a patient or customer at a teller window, a medical intake desk, an ATM, or any other facility where a user is required to divulge sensitive information.

For example, U.S. Pat. No. 6,241,151 for SELF SERVICE TERMINAL issued Jun. 5, 2001 to Stephen Swaine et al. teaches a self service terminal (SST) that has a front portion including a user interface located within a fascia. The fascia has a concave inner surface that defines a privacy area and which reduces reflection of sound. The inner surface is bounded by one or more extremities which project out from the terminal. The fascia has a canopy that extends beyond the projecting extremities. In use, the user places his head within or in proximity to the privacy area for increased privacy when using the terminal.

U.S. Pat. No. 4,773,338 for TRANSACTION SECURITY SYSTEM AND MODULAR TRANSACTION PROCESSING CENTER issued Sep. 27, 1988 discloses a transaction security device consisting of a booth of a material and construction capable of selective voluntary entry and involuntary personnel retention and incorporating a transaction interface; entrance means for said booth; a closure for said entrance means, and control means adapted to secure and unsecure at least said entrance means; and cooperating with said booth, disposed, therein, or indeed independent thereof, at least one secondary enclosure adapted to contain apparatus disposed upon at least one turntable within a housing module composed of an enclosure, portions of which are independently rotatable about said turntable and the devices disposed thereon; and means for access to the interior of said housing and with said transaction interface.

U.S. Pat. No. 4,813,475 for TEMPERATURE CONTROL MEANS FOR A SELF SERVICE BANKING SYSTEM issued Mar. 21, 1989 to Edward F. Couvrette provides a self service banking system including a walk-in kiosk housing an Automatic Teller Machine (ATM). The kiosk includes a pivotable interior access door on one end thereof which is pivotable between open and closed positions and a side wall rotatable quarter panel expansion area for allowing access to the interior of the ATM. The kiosk provides a secure enclosed environment for the automatic teller machine (ATM) and its contents. An air distribution system, a laminated wall insulation, heating and cooling systems and their controls are provided to maintain the interior temperature and humidity of the kiosk within the normal temperature and humidity operational range of the computer of the ATM during exposure of the kiosk to a wide range of ambient temperatures and humidity beyond the acceptable operating temperature and humidity range of the ATM and its computers.

U.S. Pat. No. 4,821,118 for VIDEO IMAGE SYSTEM FOR PERSONAL IDENTIFICATION issued Apr. 11, 1989 to Roget F. Lafreniere teaches a video image system for rapidly (in a few seconds) recording a person and his identification (ID) card makes video images of the person's hand palm and face along with the ID card presented by the person that may be a badge, card, drivers license, passport, or other item issued by some authority, and combines those images and presents the combined image on a video monitor for immediate inspection by a guard, store clerk or attendant, and, in addition, stores the combined image along with time and date superimposed thereon so that it can be reviewed later. The system includes at a designated place entered by the person to be recorded, a viewing table in easy reach of the person on which there are viewing areas for the person's palm and the ID card that he presents and video cameras arranged for scanning his palm, ID card and his face producing video images that are combined electronically producing a combined video image of the palm. An ID card and face may be viewed on a video monitor and recorded on a video cassette recorder (VCR) along with the time and date. The combined image that is recorded can be reviewed later as a review of the identification event.

None of the patents and published patent applications, taken singly, or in any combination are seen to teach or suggest the novel Modular Privacy Booth for Cooperative Use with a Teller Station, ATM, or the like of the present invention.

SUMMARY OF THE INVENTION

In accordance with the present invention there is provided a privacy booth for isolating a user from the surrounding environment so as to provide acoustical and, visual privacy to the user. A single privacy booth may be utilized when a user must interact with an electronic device or terminal, for example, an ATM. When interaction with a human, for example, a bank teller, a pair of joined privacy booths provide acoustical and visual privacy to both interacting parties. The solid but possibly transparent, reinforced, "bullet-proof", etc. barrier between the user and the teller helps prevent "snatch and grab" type crimes and protects the teller from armed robbery attempts as well as other types of assault.

Access to the user's privacy booth is controlled using an access keypad. The access keypad may incorporate one or several devices such as a keyboard/keypad, a magnetic strip card reader, an OCR bar code reader, a Quick Response (QR) code optical reader, and a biometric scanner, for example, a fingerprint scanner.

Semi-circular doors open when a user enters an acceptable entry code or presents acceptable media.

A transaction pass-through box or tube allows the passing of paper documents back and forth between the user and the teller. Security features include a backscatter detector for detection of dangerous objects or materials placed in the pass-through box or tube. Additionally, each end of the pass-through box or tube is closed by a door that is interlocked such that only a door at one end of the pass-through box or tube may be opened at a time.

When the transaction(s) are complete, the user causes the door to reopen and leaves the privacy booth.

Optionally, the privacy booth may be equipped with a floor raising mechanism. A disabled user in a wheel chair or similar conveyance may remain seated while being elevated to an equivalent height of a standing user. The floor of the privacy booth may be rotated (typically 180°) to facilitate exiting of a wheel chair bound disabled user. Mechanisms for floor raising and rotating are typically located in an enclosure that hangs below the privacy booth necessitating installation of the privacy booth on an elevated floor that is typically ramp or lift accessible.

It is, therefore, an object of the invention to provide a privacy booth to enclose a user to provide acoustical and visual privacy to the user when he or she is divulging sensitive private information.

It is another object of the invention to provide a privacy that is substantially circular and has semi-circular doors that selectively open and close booth to enclose a user.

It is an additional object of the invention to provide a privacy booth to enclose a user that incorporates an entry keypad to allow only authorized users to open the door and enter the privacy booth.

It is a further object of the invention to provide a privacy booth connected to a second privacy booth, the first privacy booth enclosing a user thereby allowing the user to divulge sensitive personal information to a teller in the second privacy booth.

It is a still further object of the invention to provide a privacy booth to enclose a user having a transaction pass-through tube or box for bi-directionally transferring paper documents, cash, or other physical items between the user and the teller.

It is yet another object of the invention to provide a transaction pass-through tube or box having interlocked doors at each end thereof.

It is another object of the invention to provide a transaction pass-through tube or box having a backscatter detection system to help prevent contraband from reaching a teller.

It is yet another object of the invention to provide a privacy booth to enclose a user wherein a teller in the second privacy booth may activate an alarm when the need arises.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein:

FIG. 4 is a top plan, schematic view of a single privacy booth with a user interacting with an ATM or the like;

DETAILED DESCRIPTION OF THE PREFERRED EMBODIMENT

The present invention provides modular privacy booths for cooperative use with a teller station, ATM, or the like. The novel privacy booth may be used in applications where a customer, client or other person may securely reveal sensitive personal data or information while minimizing the risk of inadvertently sharing such data or information with a person unauthorized to receive such information. As used hereinafter, the term user is intended to represent any client, patient, or other such person in need of privacy to conduct a transaction.

The novel privacy booth may be used individually, for example, to protect the privacy at an ATM or other similar electronic work station. When two of the privacy booths are interconnected back-to-back for applications such as teller stations, etc., the privacy of both the user and the teller are protected.

Figure 1A:
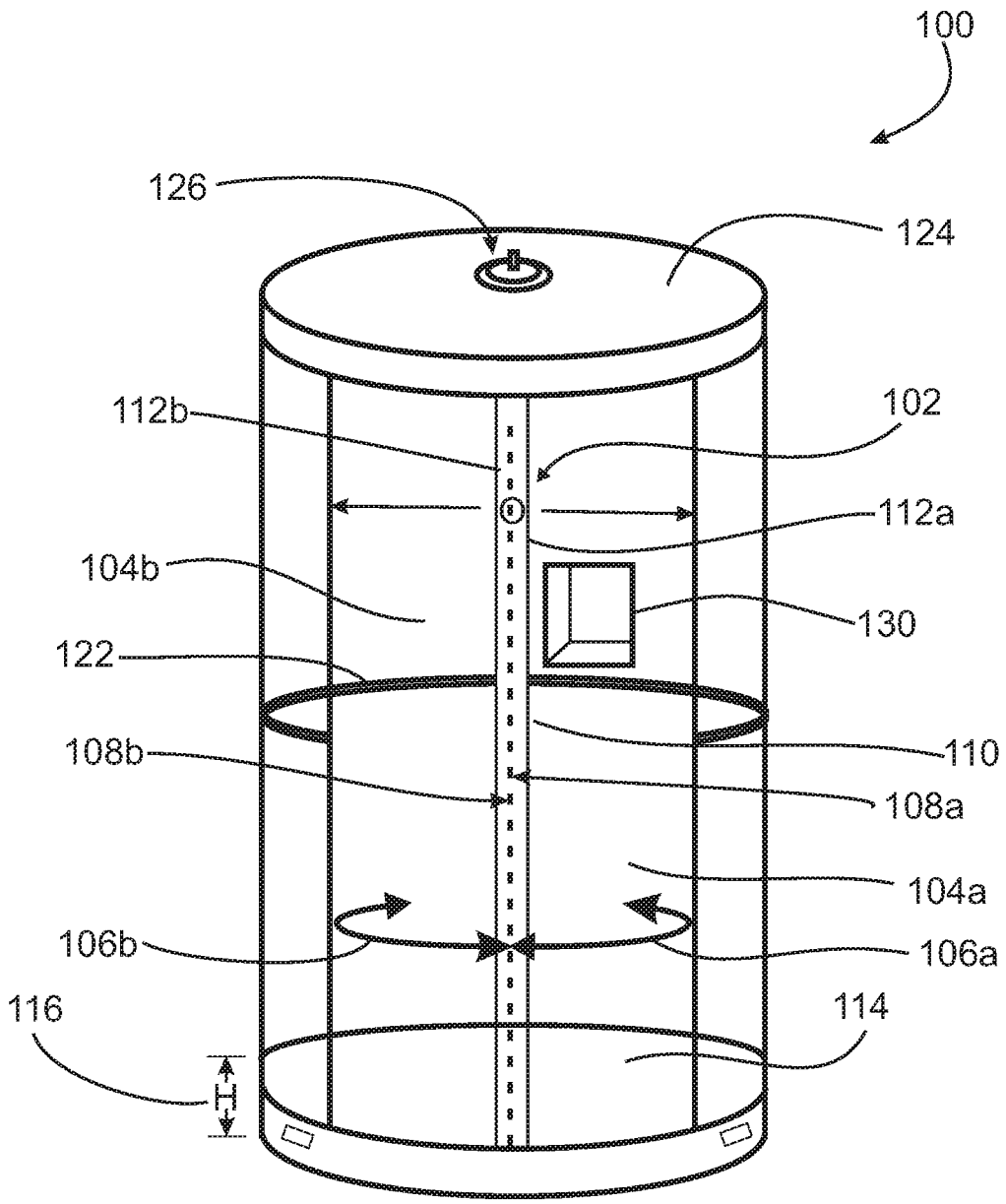
FIG. 1A is a simplified front perspective, schematic view of a view of a first embodiment of a privacy booth in accordance with the invention.

Referring first to FIG. 1A, there is shown a simplified front perspective, schematic view of a first embodiment of a privacy booth in accordance with the invention, generally at reference number 100.

Privacy booth 100 is structure having arcuate upstanding walls, typically forming a substantially cylindrical structure. It will be recognized that privacy booths in accordance with the invention may be constructed with arcuate upstanding walls to form structures other than circular structures. In still other embodiment, privacy booths may be constructed with a mix or arcuate and non-arcuate upstanding walls. In additional embodiments, privacy structure may be constructed with nothing but non-arcuate upstanding walls. Consequently, privacy booths having a wide variety of cross sectional shapes may be constructed. Therefore, the invention is not considered limited to a particular cross sectional shape. Rather the invention includes privacy booths having any cross-sectional shape.

An opening "O" 102 extends across a front facing region of privacy booth 100. Opening 102 is sized to accommodate a wheelchair, power chair, or other conveyance suitable for use by a handicapped person 254*c*, best seen in FIG. 6, to enter privacy booth 100 to transact private business.

Opening 102 may selectively be closed by a sliding door, typically implemented as a pair of sliding doors 104*a*, 104*b* that selectively open and close in directions shown by respective arrows 106*a*, 106*b*. In a closed position, outer edges 108*a*, 108*b* of respective sliding doors 104*a*, 104*b* meet at a central point 110, their outer edges abutting one to the other. When necessary, seals 112*a*, 112*b* may be applied to respective door outer edges 108*a*, 108*b* to improve acoustical privacy by limiting the amount of sound emanating from within privacy booth 100 to an external space, not specifically identified.

A door opening apparatus, not shown, is operatively connected to sliding doors 104*a*, 104*b* to perform door opening and door closing function upon command. Such door opening and closing mechanisms are believed to be well known to those of skill in the art and, consequently, are not further described or discussed herein.

Figure 5A:
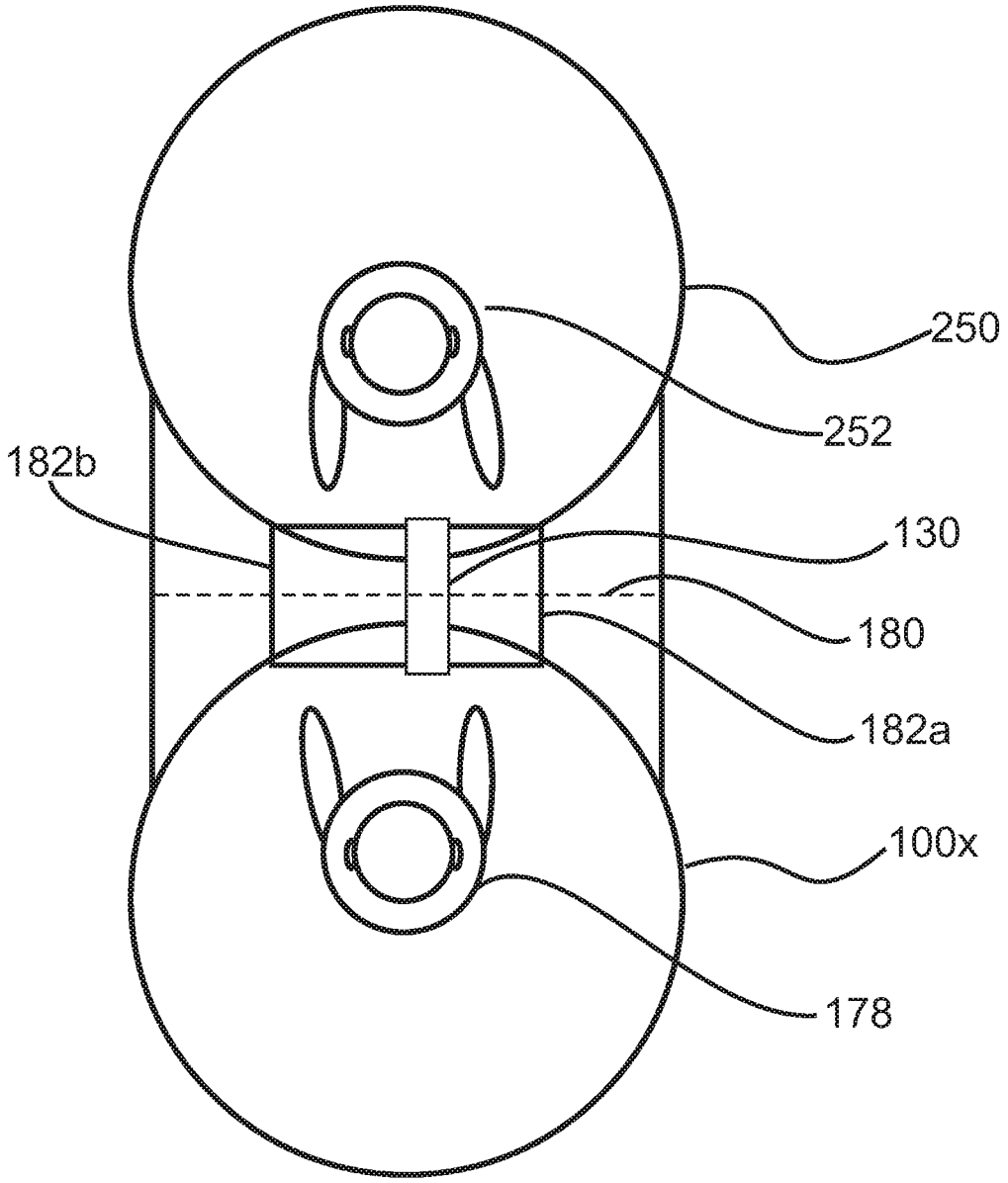
FIG. 5A is a top plan, schematic view of a pair of privacy booths connected one to another in accordance with the invention.

An optional transaction pass-through tube or box 130 connects the interior of privacy booth 100 to a space directly behind the booth, typically a contiguous connected second privacy booth 250, best seen in FIG. 5A. When implemented, the distal end of transaction pass-through tube or box 130 terminates in second privacy booth 250. A more detailed description of transaction pass-through tube or box is provided hereinbelow.

In privacy booth 100, a floor 114 is typically raised as small distance "H" 116 above the level of a surface, not specifically identified, upon which privacy booth 100 is supported.

A handrail 122 encircles the entire interior surface of privacy booth 100.

A top or dome 124 completely seals the interior of privacy booth 100. A signal assembly 126, discussed in more detail hereinbelow is affixed atop dome 124, typically proximate an apex, not specifically identified, of dome 124. It will be recognized that structures, not shown, other than domes 124 may be used to seal the upper portion of privacy booth 100.

Figure 1B:
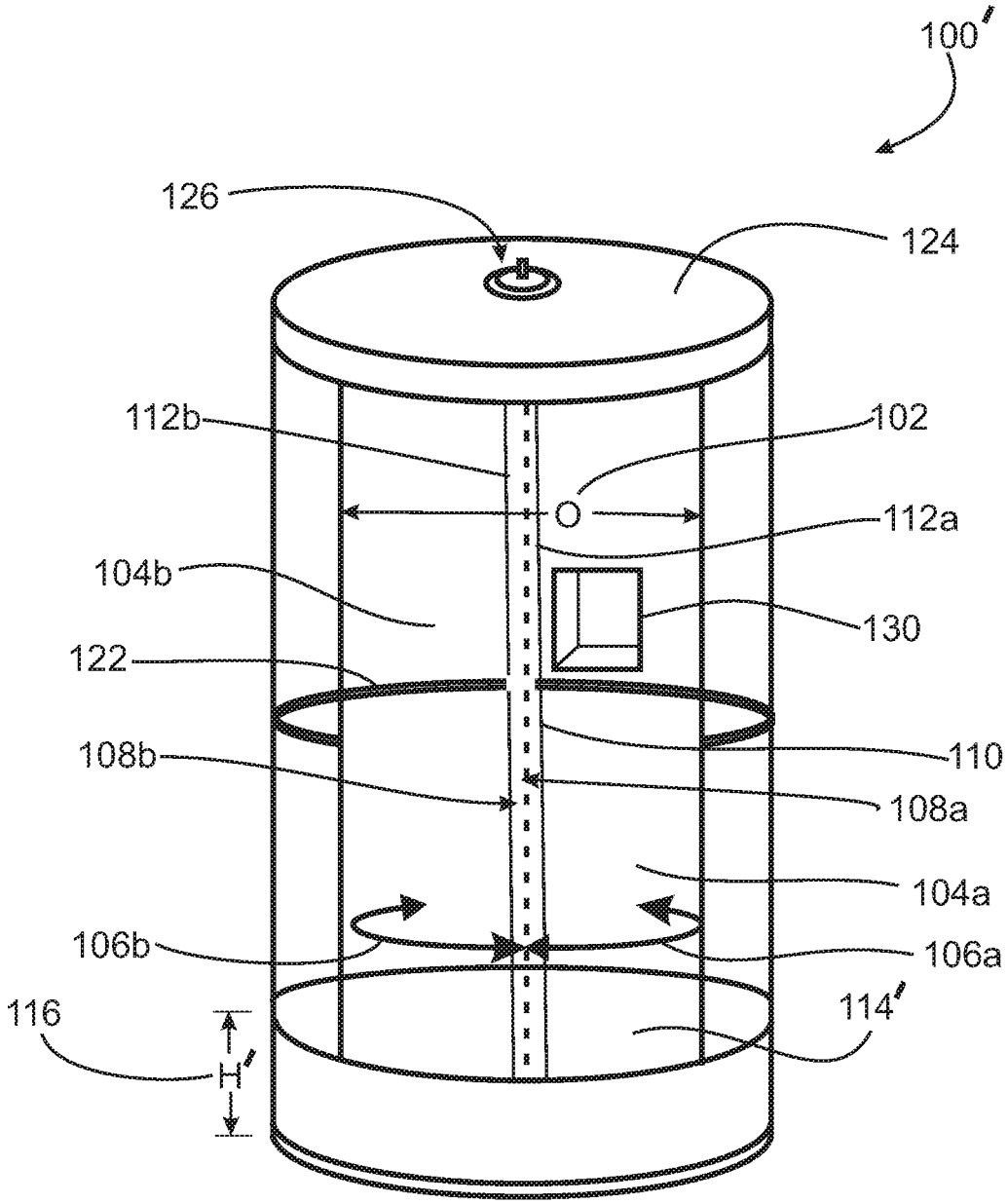
FIG. 1B is a simplified front perspective, schematic view of a view of the privacy booth of FIG. 1 but having a raiseable floor.

Referring now also to FIG. 1B, there is shown a simplified front perspective, schematic view of a second embodiment of a privacy booth 100, generally at reference number 100".

Privacy booth 100' has all the previously described features and structures but in addition has an elevatable floor 114' that raises a person seated in a wheel chair, scooter, or other such conveyance to a height whereat they may utilize privacy booth 100' in an equivalent manner to a standing person. As may be gleaned from FIG. 6, floor 114 is elevatable relative to transaction pass-through tube or box 130. Floor 114' is raised by a floor elevating mechanism, not shown, in FIG. 1B but rather shown in FIGS. 2C and 2D, that may include motor driven scissor jacks, one or more hydraulic cylinders, not shown, or any other suitable similar lift system components. A control system suitable for use with the floor raising and rotating mechanisms of FIGS. 2C and 2D is shown in FIG. 2E. If hydraulic cylinders are used to raise floor 118', support pumps, tanks, valves, etc., none shown, all known to those of skill in the hydraulic arts, are required for cooperative uses with one or more hydraulic cylinders.

Note that privacy booth 100 and 100' are typically sized to accommodate two adult persons inside, including one adult person in a wheel chair or similar conveyance.

Figure 2A:
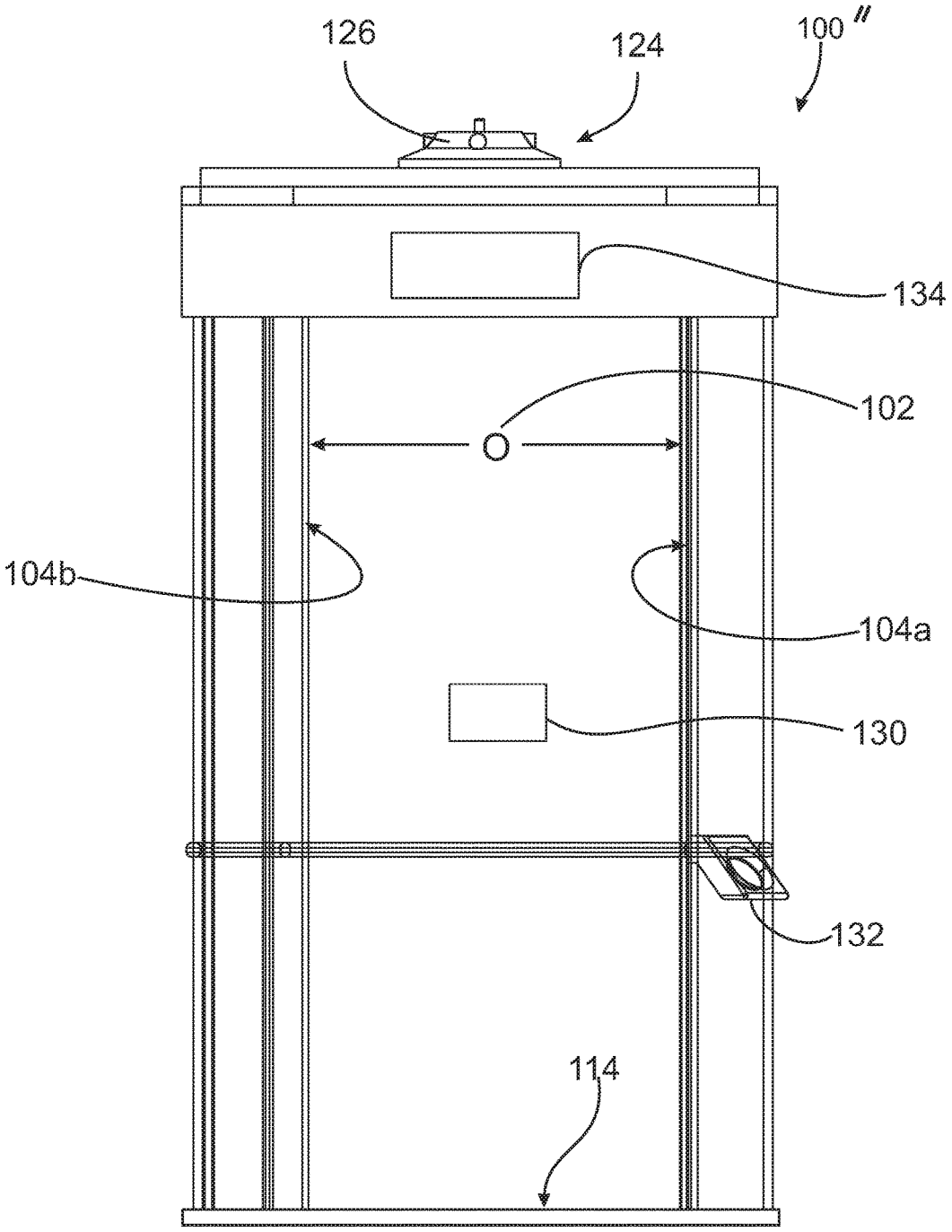
FIG. 2A is a simplified front elevational, schematic view of the privacy booth of FIG. 1A.
Figure 3:
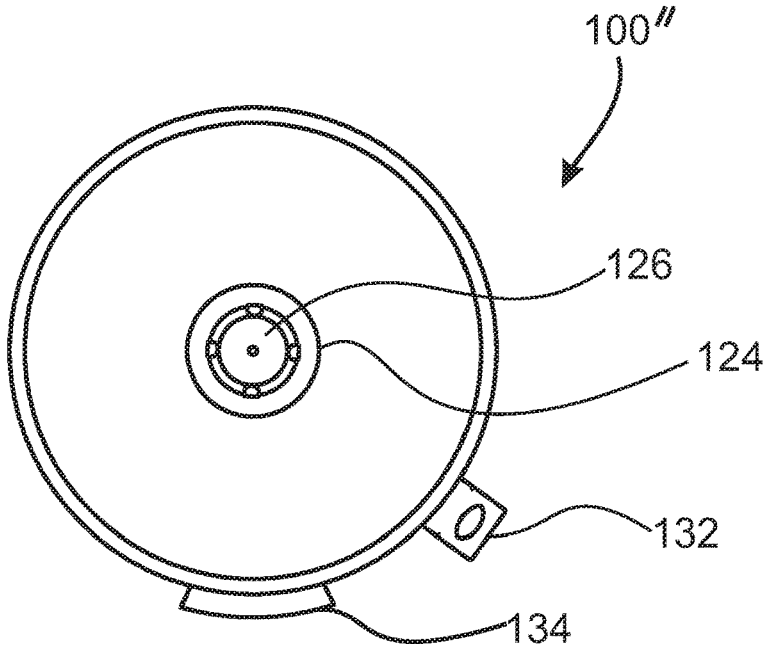
FIG. 3 is a top plan schematic view of the privacy booth of FIG. 2.

Referring now also to FIGS. 2A and 3, there are shown simplified front elevational, and top plan schematic views, respectively of the privacy booth similar to privacy booth 100 of FIG. 1A.

Additional features not shown in FIGS. 1A and 1B include an access "keypad" 132 and an external speaker 134. The term "access keypad" is used to refer to devices that may include keypads, biometric scanners, magnetic card readers, RFID devices, OCR card readers, and any other access control devices.

External speaker 134 may be utilized in a number of ways but generally is connected as part of an intercom system, not shown. External speaker may, in some installations, be designated for emergency use only.

Figure 2B:
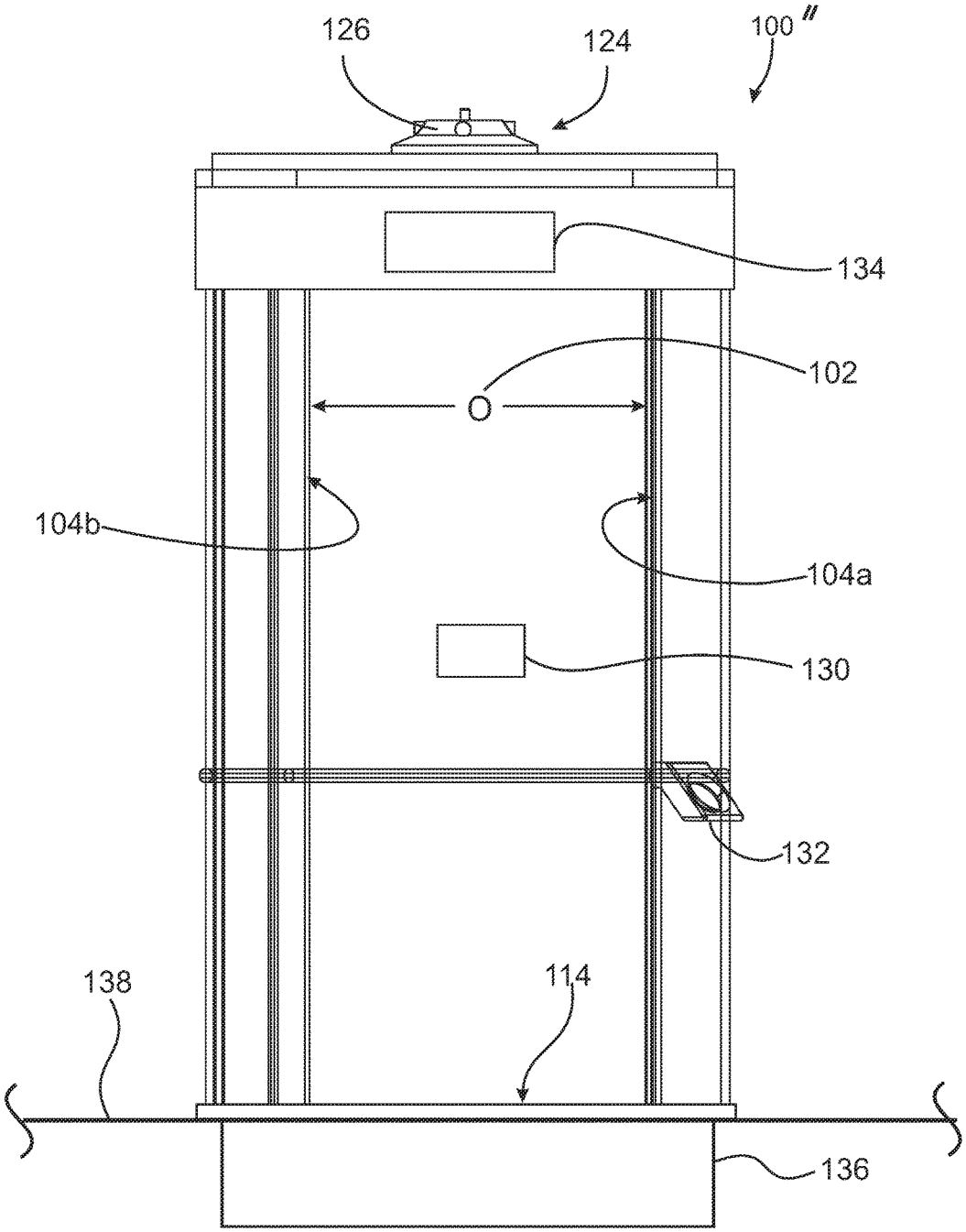
FIG. 2B is a simplified front elevational, schematic view f the privacy booth of FIG. 1B showing an underfloor equipment compartment.
Figure 2C:
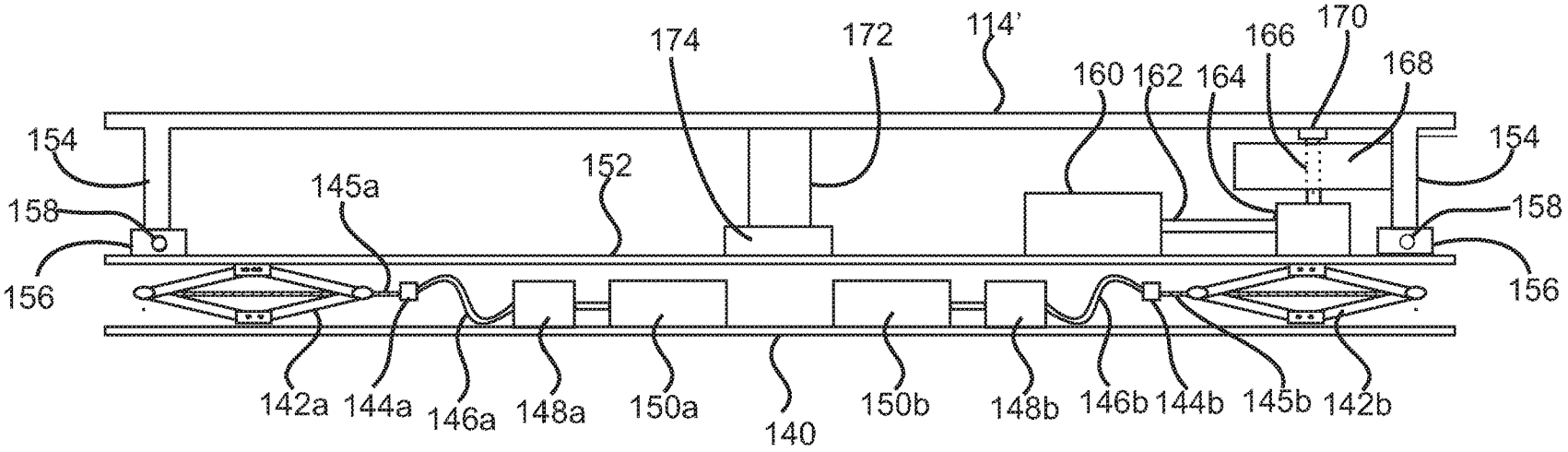
FIG. 2C is a simplified, cross-sectional, schematic view of floor raising/rotation mechanism of the privacy booth of FIG. 2B with the floor in a lowered position.
Figure 2D:
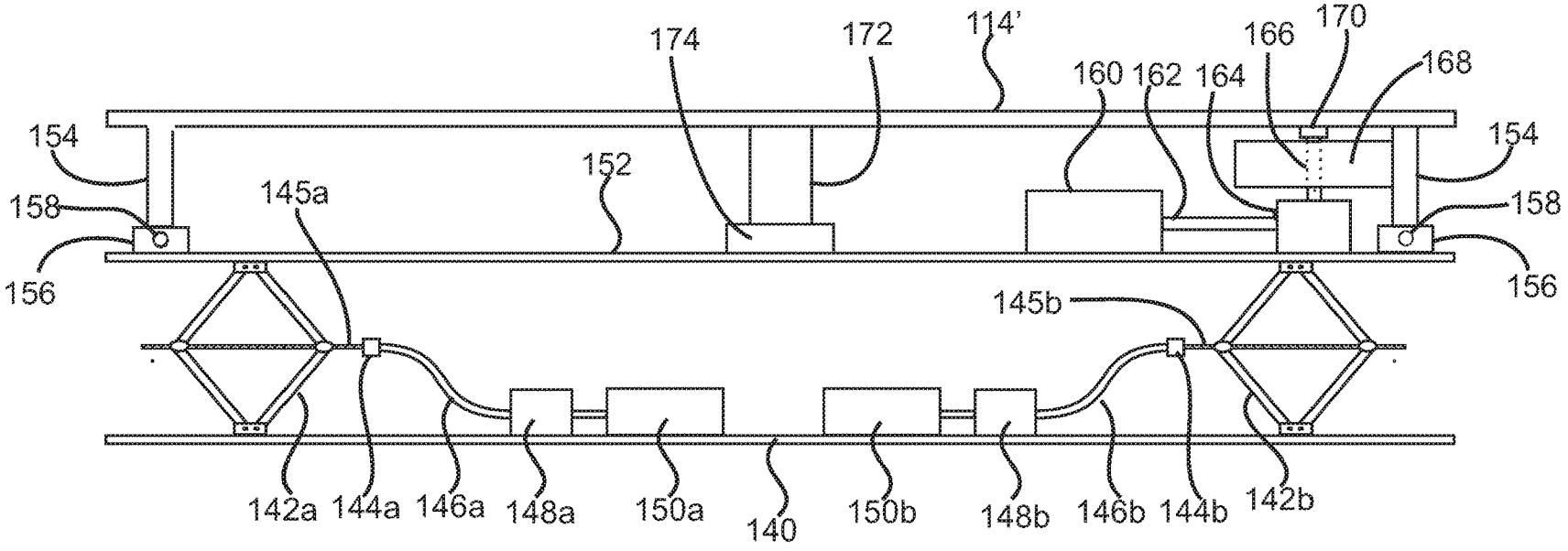
FIG. 2D is a simplified, cross-sectional, schematic view of floor raising/rotation mechanism of the privacy booth of FIG. 2B with the floor in a raised position.
Figure 2E:
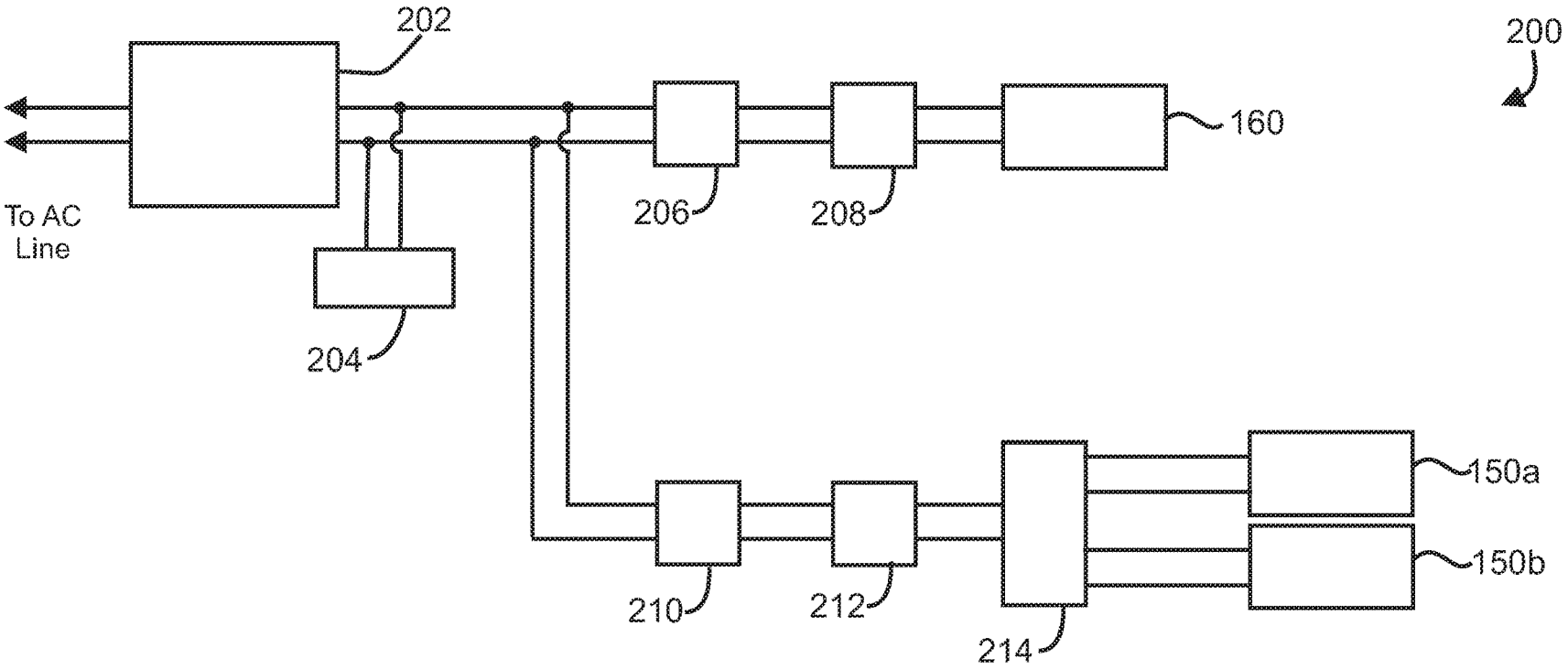
FIG. 2E is a simplified schematic functional block diagram of a control system associated with the mechanisms of FIGS. 2C and 2D.

Referring now also to FIG. 2B, there is shown a simplified front elevational, schematic view of the privacy booth 100" of FIG. 1B. A sub-floor equipment enclosure 136 is shown depending downwardly from the bottom of privacy booth 100".

Referring now also to FIGS. 2C and 2D, there are shown partial cross-sectional, schematic views of a floor lift and rotate mechanism with floor 114' in a lowered and raised position, respectively.

As seen in FIGS. 2B, 2C and 2D, the floor lift and rotate mechanism is located below floor 114 and within a footprint of the enclosure.

A bottom plate 140 supports a pair of scissor jacks 142*a*, 142*b* that support an intermediate support plate 152. Scissor jacks 142*a*, 142*b* each have a helical screw shaft 145*a*, 145*b* that raise and lower the respective jack. Scissor jacks are believed to be well known and may readily be designed and constructed to achieve the required lift of approximately between 2 and 6 inches A mechanism may be required to synchronize the speed of rotation of the helical screws 145*a*, 145*b* of jacks 142*a*, 142*b* to ensure level lifting of privacy booth floor 114'. It will be further recognized that a lift implementation using a single scissor jack may be possible as well as implementations using more than two scissor jacks may also be possible. Consequently, the invention is not considered limited to the two scissor jack implementation chosen for purposes of disclosure. Rather the invention is intended to incorporate implementations using any number of scissor jacks as well as implementations using pneumatic and/or hydraulic cylinders, or similar lift generating devices.

A mechanical coupler 144*a*, 144*b* connects respective helical screws 145*a*, 145*b* of jacks 142*a*, 142*b* to a first end of a flexible shaft 146*a*, 146*b*.

An opposing end of flexible shafts 146*a*, 146*b* is connected to an input of a geared speed reducer 148*a*, 148*b*, respectively.

An output of geared speed reducer 148*a*, 148*b* is connected to a drive shaft of a high torque, low speed DC motor 150*a*, 150*b*. A DC motor is chosen for ease of speed control and reversibility.

Intermediate support plate 152 is functionally attached to scissor jacks 142*a*, 142*b* and is raised and lowered thereby. Intermediate support plate 152 supports a floor 114' rotation mechanism.

Floor 114' has a central support axle 172 permanently affixed to a lower surface, not specifically identified, thereof. A lower end of central support axle 172 is rotatively received in and retained by a lower thrust bearing 174 that allows central support axle 172 to freely rotate therein.

Floor 114' has a drive rim 154 depending from the lower floor surface adjacent its outer perimeter, not specifically identified, of floor 114. A lower edge of drive rim 154 is supported on an upper surface of a "lazy susan" style support bearing 156. Support bearing typically contains at least one bearing chase containing ball bearings exemplified by ball bearings 158 shown in FIGS. 2C, 2D.

A rubber drive tire 168 is positioned to engage an inside vertical surface, not specifically identified, of drive rim 154. That inner surface, not specifically identified, of drive rim 154 may be roughened or have a non-skid surface treatment, neither shown, to ensure good engagement of rubber driver tire 168 with drive rim 154.

Rubber drive tire 168 is rigidly attached to a drive axle 166. A lower end of drive axle 168, not specifically identified, is operatively connected to a right-angle geared speed reducer 164. An input to right-angle geared speed reducer 164 is operatively connected to a drive shaft 162 of an additional high torque, lower speed DC motor 160.

Note that in FIG. 2C, floor 114' is in a lowered position while in FIG. 2D, floor 114' is in a raised position.

Referring primarily to FIG. 2C, the floor lift and rotate mechanism may comprise a floor lift mechanism, a floor rotate mechanism, and intermediate support plate 152 located between and separating the floor lift mechanism and the floor rotate mechanism. The floor lift mechanism may comprise motors 150*a* and 150*b*, geared speed reducers 148*a* and 148*b*, flexible shafts 146*a* and 146*b*, mechanical couplers 144*a* and 144*b*, and scissors jacks 142*a* and 142*b*. The floor rotate mechanism may comprise support axle 172, thrust bearing 174, motor 160, driveshaft 162, geared reducer 164, drive axle 166, drive tire 168, and drive rim 154.

DC motor 150*a*, 150*b* and 160 are connected to a controller. Referring now also to FIG. 2E, there is shown a simplified schematic functional block diagram of a control system suitable for controlling a raising, lowering, and rotation of floor 114', generally at reference number 200.

A DC power supply/battery charger 202 is typically connected to AC line power using connection devices and/or techniques believed to be well known to those of skill in the art. DC power supply/charger 202 is connected to a backup battery 204. Battery 204 allows the floor 114' to be raised, lowered, or rotated in event of a power failure.

The DC power supply charger, in cooperation with battery 204 provides power to operate both the floor raise/lower and floor rotation mechanisms.

A Forward/Reverse switch 206, typically located inside privacy booth 100" (FIG. 2A) is configured to control the direction of rotation of floor 114' by controlling the polarity of the DC voltage being delivered to floor rotation motor 160.

An output from Forward/Reverse switch 206 passes through a pair of limit switches, shown schematically at reference number 208, that stop the rotation of floor rotation motor 160 when floor 114' reaches one of two predetermined angular orientations. Limit switches, procedures for placing limit switches, and wiring limit switches into motor control circuitry are believed to be well known to those of skill in the art and, consequently, are not further described or discussed herein.

A floor Raise/Lower switch 210, typically located within privacy booth 100" (FIG. 2A) operates in a similar manner to Floor Forward/Reverse switch 206 and functions to reverse the polarity of the DC power depending on the direction of rotation desired from motors 150*a*, 150*b*.

An electrical output from Floor Raise/Lower switch 210 passes through a second pair of limit switches, shown schematically at reference number 212 that stop the rotation of floor raise/lower motors 150*a*, 150*b* when floor 114' reaches a predetermined height and when floor 114' and when floor 114' is returned to is lowered, home position. Limit switches, procedures for locating limit switches, and wiring limit switches into motor control circuitry are believed to be well known to those of skill in the art and, consequently, are not further described or discussed herein.

It will be seen from FIGS. 2C and 2D that separate floor lift mechanism and its associated forward/reverse switch 206, and the floor raise/lower mechanism above intermediate support plate 152 and its associated floor raise/lower switch 210 assure that the floor lift and rotate mechanism lifts, lowers, and rotates floor 114 (or 114' or 114") independently of the enclosure of privacy booth. 100 (or 100' or 100").

In a floor raising implementation using two or more scissor jacks 142*a*, 142*b*, etc., it is necessary to synchronize the rise of the jacks. Uneven rising of scissor jacks 142*a*, 142*b* could result in floor 114' becoming non-level. A large number of ways exist to provide such control. For example, encoder wheels, not shown, could be affixed to the helical screws 145*a*, 145*b*, of scissor jacks 142*a*, 142*b*. Signal outputs, not shown, from an encoder operatively connected to the encoder wheels could provide input to two or more motor speed controllers connected to floor lift motors 150*a*, 150*b*. Such a system is represented schematically as speed controller 214. As many other control devices, methods, and/or systems could readily be utilized, the invention is not considered limited to the optical wheel encoder system utilized for purposes of disclosure. Rather, any suitable speed controller that synchronizes the speed of floor raise motors 150*a*, 150*b* may be substituted therefor.

Further, as the floor raise/lower and floor rotation systems described in the context of privacy booth 100" may also be adapted to any other of the privacy booth embodiments described and claimed herein.

In summary, privacy booth 100 (or 100' or 100") is a self-contained booth enabling a wheelchair bound user to wheel into privacy booth 100 (or 100' or 100"), adjust height of floor 114 (or 114' or 114") relative to the transaction pass-through tube or box 130, and adjust an angular orientation of a direction of roll of the wheelchair, from within privacy booth 100 (or 100' or 100").

Figure 4:
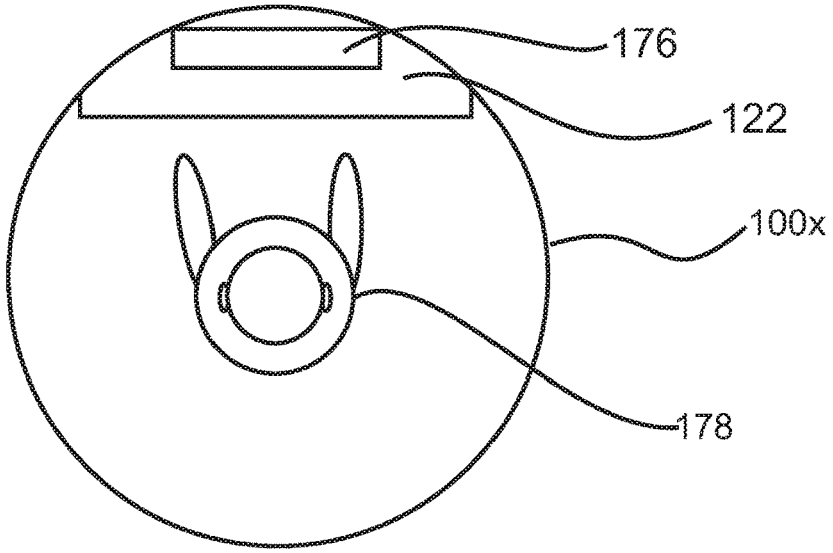

Referring now also to FIG. 4, there is shown a top plan, schematic view of a single privacy booth 100*x* selected from privacy booths 100, 100', or 100". A single privacy booth 100*x* is useful in applications wherein a user interacts with an ATM or other electronic device or system and wherein the user needs to maintain privacy while disclosing sensitive personal information.

A user 178 is shown interacting with an ATM or the like 176. A work surface or shelf 122 is provided for the convenience of user 178. All of the other features previously discussed may readily be incorporated into privacy booth 100*x*.

Referring now also to FIG. 5A, there is shown a top plan, schematic view of a first privacy booth 100*x* selected from privacy booths 100, 100', or 100" connected to a second privacy booth 250. Privacy booth 100*x* is configured for occupancy and use by a user. Privacy booth 250 is adapted for occupancy and use by a teller or the like. The internal details of privacy booth 250 are discussed in more detail hereinbelow.

A barrier 180 separates the internal regions of privacy booths 100*x* and 250. Barrier 180 may optionally be completely or partially transparent to facilitate visual communication between privacy booth 100*x* and 250. It is assumed that barrier 180 may be made from a bullet proof material to provide security primarily to teller 252.

Privacy booths 100*x* and 250 are typically joined by transaction pass-through tube or box 130 sized and configured to allow two-way movement of paper documents, bills, and coins. Transaction pass-through tube or box 130 is equipped with interlocked doors best seen in FIG. 5B.

Figure 5B:
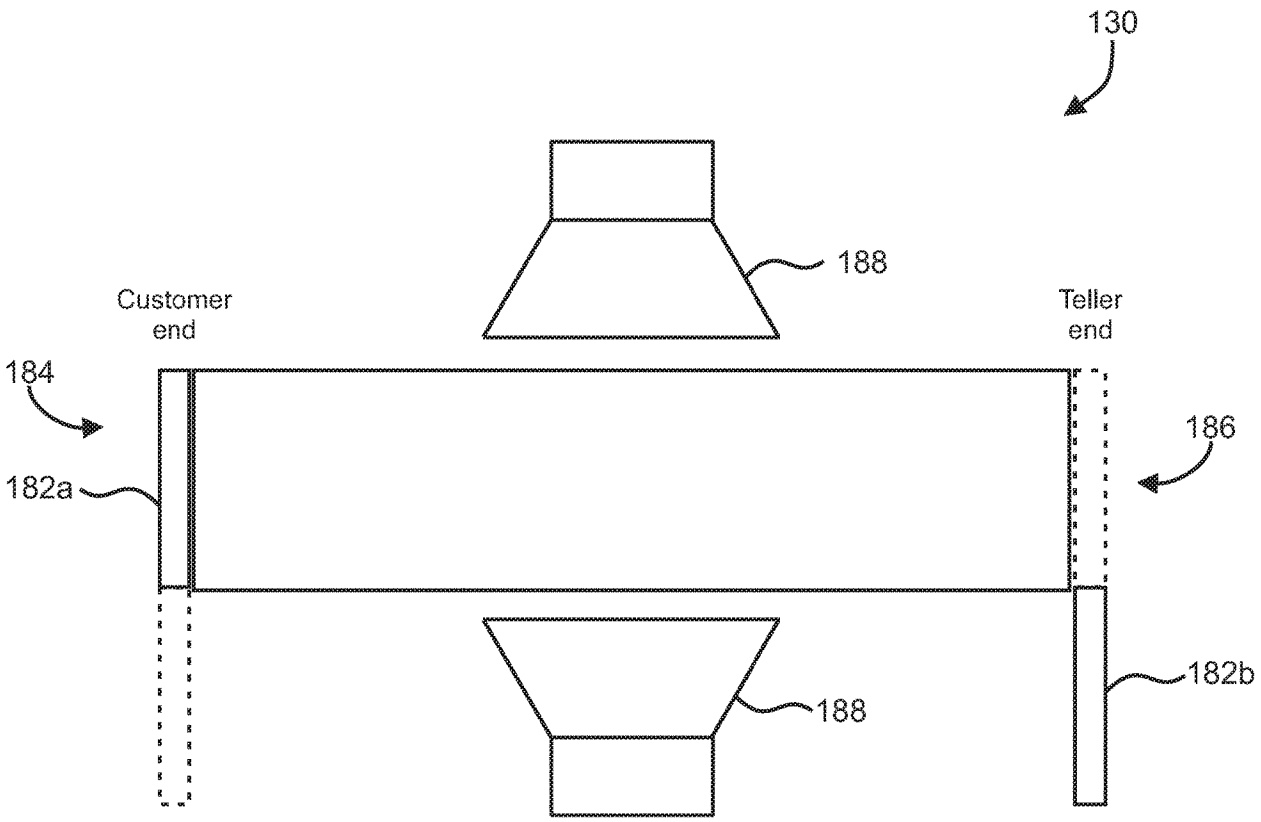
FIG. 5B is a detailed top plan, schematic view of a transaction pass-through tube or box.

Referring now also to FIG. 5B, there is shown a top elevational, schematic view of a representative transaction pass-through tube or box 130.

Transaction pass-through tube or box 130 has interlocked doors or other sealing devices 182*a*, 182*b* at the customer end and the teller end, respectively. For clarity, doors or other sealing devices 182*a*, 182*b* are represented as sliding devices alternately movable between a sealed position 184 and an open position 186. Because of an interlocking system, only one of doors or other sealing devices 182*a*, 182*b* may be in open position 186 at one time. In other words, if doors or other sealing devices 182*a* is in open position 186, doors or other sealing devices 182*b* must be in sealed position 184. This arrangement prevents direct, potentially harmful communication between customer 152 and teller 254.

Typically, transaction pass-through tube or box 130 is formed from an explosion resistant (i.e., reinforced) material and is equipped with a backscatter detection system to alert teller 252 of the presence of any harmful material in transaction pass-through tube or box 130. Such materials may include small quantities of liquid explosive, plastic explosives, guns, knives, etc. Backscatter detection systems are believed to be well known to those of skill in the art and, consequently, are not further described or discussed herein. It will be recognized that any appropriate backscatter detection system may be used as part of the novel privacy booth system.

Referring again also to FIG. 5A, a schematic representation of a user (e.g., customer) 178 is shown within privacy booth 100*x*. A schematic representation of a teller or other similar person 252 is shown within privacy booth 250. It will be recognized that neither user 178 nor teller 252 form any part of the invention but are shown to illustrate the intended function of the privacy booths of the invention.

Figure 6:
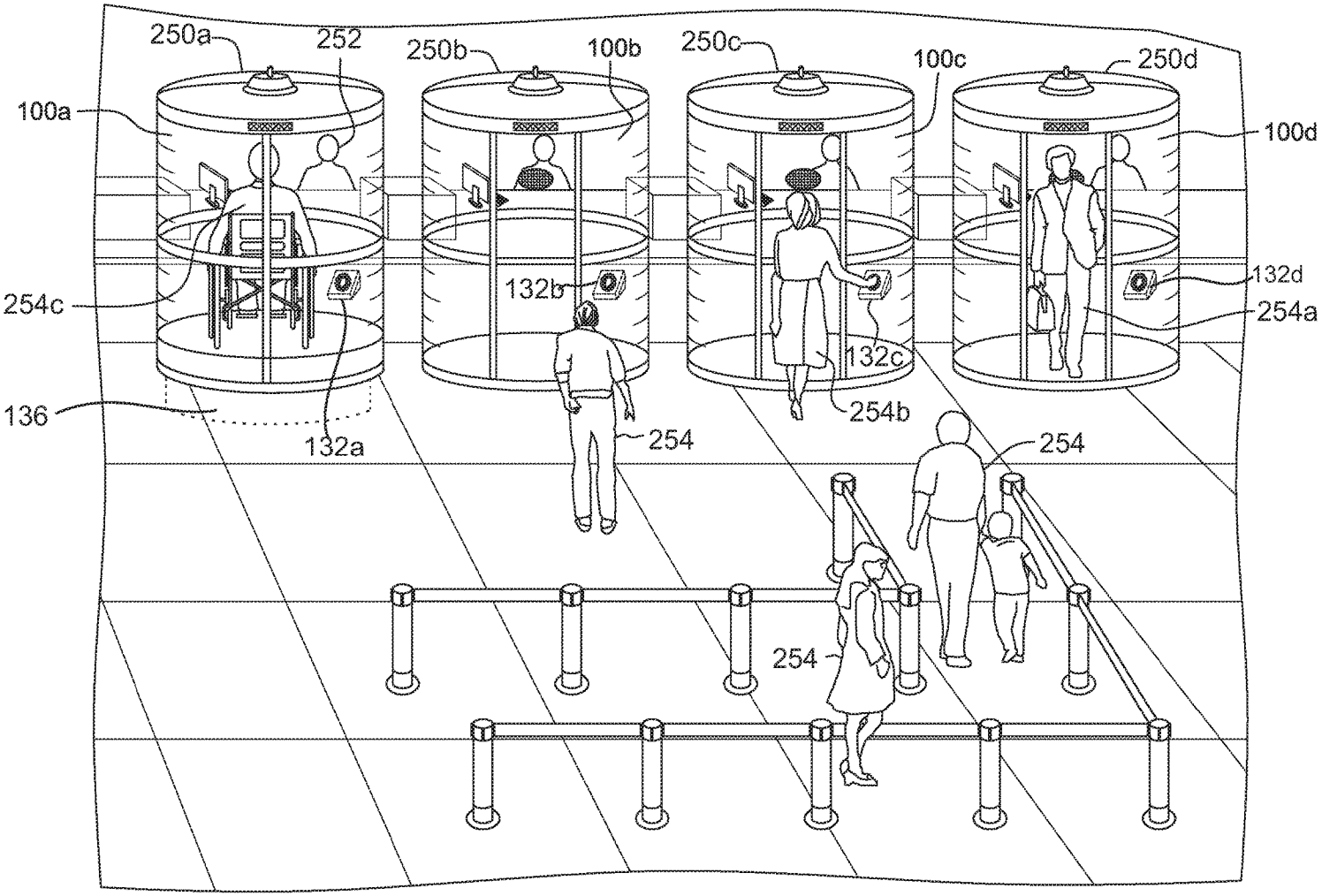
FIG. 6 is an architectural rendering, front perspective view of four privacy booths in a typical operating environment.

Referring now also to FIG. 6, there is shown an architectural rendering of four privacy booths 100*a* . . . 100*d* in a typical operating environment. Privacy booths 100*a*, 100*b*, 100*c*, 100*d* are disposed adjacent one another in a customer lobby, not specifically identified, of a bank or similar institution that forms no part of the invention. A single handicap access booth 100*a* is a privacy booth 100" as seen in FIGS. 1B and 2B is shown in FIG. 6. Note that the equipment compartment 136 is shown recessed into the floor, not specifically identified. Three "conventional" privacy booths 100 as seen in FIG. 1A and designated 100*b*, 100*c*, 100*d* are disposed adjacent thereto. It will be recognized that all privacy booths 100*a* . . . 100*d* may be made handicapped accessible (i.e., accommodate a wheelchair constrained user).

Customers (i.e., users) 254, 254*a*, 254*b*, 254*c* . . . 254*n* are shown in various stages of use of privacy booths 100*a* . . . 100*d*. Customers 254 are waiting in a queue for a chance to conduct business in one of privacy booths 100*a* . . . 100*d*.

Customer 254*a* is exiting privacy booth 100*d*, presumably having completed his or her business therewithin.

Customer 254*b* is utilizing access keypad 132*c* to allow entry into privacy booth 100*c*.

Customer 254*c*, seated in a wheelchair or similar conveyance, not specifically identified, within privacy booth 100*a*, is presumably in the process of conducting his or her business therein.

Attached to each of privacy booth 100*a* . . . 100*d* is an attached corresponding teller booth 250*a* . . . 250*d*, respectively. As best seen in teller booth 250*a*, a teller 252 is transacting business with a customer 254*c*.

Figure 7:
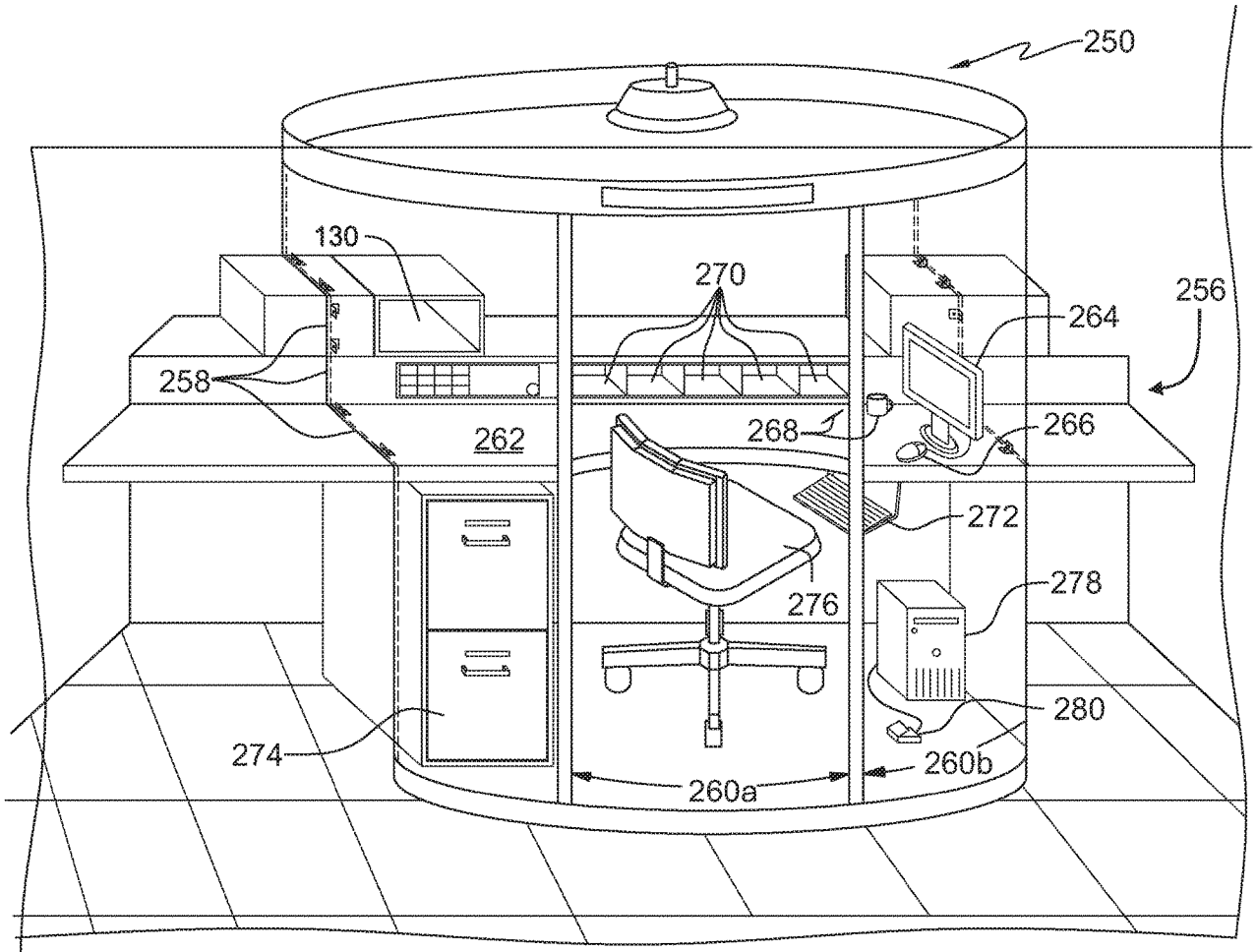
FIG. 7 is a perspective view of a typical teller station utilizing a privacy booth.

Referring now also to FIG. 7, there is shown a rear perspective, schematic view of a teller station 256 disposed in a teller booth 250.

A wall 258 of teller station 250 may be constructed to conform and seal to an existing teller station 256. Sliding doors 260*a*, 260*b* and shown in a closed position. A teller 252, not seen in FIG. 7 for sake of clarity, working within privacy booth 250 may be acoustically isolated from the space surrounding privacy booth 250.

The teller end of transaction pass-through tube or box 130 is shown. For clarity of illustration, doors 182*a*, 182*b* are not shown in FIG. 7.

Teller station "components", none of which form any part of the present invention are shown. A work surface 262 typically supports a computer monitor 264 and computer pointing device (mouse) 266. Personal objects 268, exemplified by a coffee cup and a pen) are also disposed on work surface 262. Note that personnel objects 268 form no part of the present invention. As series of "pigeon hole" compartments 270 are provided for storing paper forms, none shown, used for transacting business, A computer keyboard 272 is suspended beneath work surface 262. A file cabinet 274 a chair 276, and computer 278 are disposed on the floor, not specifically identified, beneath work surface 262 within teller workstation 258.

A "silent alarm" foot switch 280 may be provided. Foot switch 280 may be utilized in a number of ways believed to be well known to those of skill in the security arts. Consequently, foot switch 280 is not further described or discussed herein.

Since other modifications and changes varied to fit particular operating requirements and environments wifi be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A privacy booth, comprising:

a) an enclosure having an arcuate wall having a lower edge, an upper edge, a height, a transaction pass-through tube or box, a footprint, and an opening having a width therein;

b) a sliding door selectively movable between an open position and a closed position disposed in said opening, when said sliding door is in said closed position, said opening is completely closed;

c) a floor being movable in a vertical direction between a first predetermined lower level and a second, higher predetermined level relative to the transaction pass-through tube or box, said floor being rotatable between a first predetermined angular orientation and a second angular orientation, d) a top attached to said arcuate wall at said upper edge thereof, and e) a floor lift and rotate mechanism comprising a floor lift mechanism and a floor rotate mechanism, located below the floor and within the footprint of the enclosure, f) inside the privacy booth, a floor raise/lower switch and a forward/reverse switch controlling direction of the floor rotation motor, wherein the floor lift and rotate mechanism lifts, lowers, and rotates the floor independently of the enclosure, whereby the privacy booth is a self-contained booth enabling a wheelchair bound user to wheel into the privacy booth, adjust height of the floor relative to the transaction pass-through tube or box, and adjust an angular orientation of a direction of roll of the wheelchair from within the privacy booth.

2. The privacy booth as recited in claim 1, wherein said arcuate wall comprises a wall chosen from the group: a circular wall, an oval wall, and semi-circular wall.

3. The privacy booth as recited in claim 1, wherein when said floor is in said first predetermined lower level, said privacy booth accommodates a standing adult human user and when said floor is in said second higher predetermined level, said privacy booth accommodates a person seated in a wheelchair.

4. The privacy booth as recited in claim 1, wherein said opening has a width sufficient to allow passage of an adult human in a wheel chair.

5. The privacy booth as recited in claim 4, wherein said sliding door comprises a pair of sliding door sections, each of said pair of sliding door sections having an outer edge adapted and configured to abut and seal to the other of said sliding door sections when said sliding door is in said closed position, each of said sliding door sections moving away from each other until said sliding door is in said open position.

6. The privacy booth as recited in claim 1, wherein said top comprises a dome-shaped top comprising a signal assembly disposed on an external surface thereof proximate an apex of said dome-shaped top.

7. The privacy booth as recited in claim 1, further comprising:

e) an access control mechanism operatively connected to said sliding door; and f) an access control panel disposed externally to said privacy booth and operatively connected to said access control mechanism;

whereby a user wishing to open said sliding door must enter a recognized access code at said access control panel, said sliding door automatically opening upon entry of said recognized access code.

8. The privacy booth as recited in claim 7, wherein said access control panel comprises at least one mechanism chosen from the group: a keyboard, a keypad, a magnetic strip card reader, an OCR bar code reader, a Quick Response (QR) code optical reader, and a biometric scanner.

9. The privacy booth as recited in claim 8, wherein said biometric scanner comprises a fingerprint scanner.

10. A privacy booth system, comprising:

a) a pair of contiguous enclosures connected one to the other, each having an arcuate wall having a lower edge, an upper edge, a height, a footprint, a transaction pass-through device communicative with each of said pair of contiguous enclosures, said transaction pass-through device having an interlocked door at each end thereof whereby only one of said interlocked doors may be open at a time, and an opening having a width therein;

b) a sliding door disposed in at least one of said pair of enclosures, said sliding door being selectively movable between an open position and a closed position disposed in said opening, when said sliding door is in said closed position, said opening is completely closed;

c) at least one of said pair of privacy booths having a floor being movable in a vertical direction between a first predetermined lower level and a second, higher predetermined level relative to the transaction pass-through device, said floor being rotatable between a first predetermined angular orientation and a second angular orientation;

d) a top disposed in each of said enclosures, each said top attached to a respective one of said arcuate walls at said upper edge thereof; wherein at least one of the contiguous enclosures comprises a floor being movable in a vertical direction between a first predetermined lower level and a second, higher predetermined level relative to the transaction pass-through tube or box, said floor being rotatable between a first predetermined angular orientation and a second angular orientation, a floor lift and rotate mechanism comprising a floor lift mechanism and a floor rotate mechanism, inside the privacy booth, a floor raise/lower switch and a forward/reverse switch controlling direction of floor rotation, wherein the floor lift and rotate mechanism lifts, lowers, and rotates the floor independently of the enclosure, is contained beneath the floor, and is contained within the footprint of the enclosure, whereby the privacy booth is a self-contained booth enabling a wheelchair bound user to wheel into the privacy booth, adjust height of the floor relative to the transaction pass-through tube or box, and adjust an angular orientation of a direction of roll of the wheelchair from within the privacy booth.

11. The privacy booth system as recited in claim 10, wherein said transaction pass-through device comprises a backscatter detection system.

12. The privacy booth system as recited in claim 10, wherein said arcuate wall of at least one of said pair of enclosures comprises a wall chosen from the group: a circular wall, an oval wall, and a semi-circular wall.

13. The privacy booth system as recited in claim 10, wherein said sliding door of at least one of said pair of enclosures comprises a pair of sliding door sections, each of said pair of sliding door sections having an outer edge adapted and configured to abut and seal to the other of said sliding door sections when said sliding door is in said closed position, each of said sliding door sections moving away from each other until said sliding door is in said open position.

14. The privacy booth system as recited in claim 10, further comprising:

in at least one of said pair of enclosures, an access control mechanism operatively connected to said sliding door; and an access control panel disposed externally to said at least one of said pair of enclosures, and operatively connected to said access control mechanism.

15. A privacy booth system as recited in claim 10, wherein a first of said pair of enclosures comprises a user compartment and a second of said two enclosures comprises a teller compartment.

* * * * *